US006698039B1

(12) United States Patent
Park

(10) Patent No.: US 6,698,039 B1
(45) Date of Patent: Mar. 2, 2004

(54) FOOTCARE WHIRLPOOL MASSAGE INSTRUMENT EQUIPPED WITH AN OZONE GENERATOR

(75) Inventor: Jung Hoon Park, Seoul (KR)

(73) Assignee: Beaunix Co., Ltd., Seoul (KR)

( * ) Notice: Subject to any disclaimer, the term of this patent is extended or adjusted under 35 U.S.C. 154(b) by 0 days.

(21) Appl. No.: 10/261,996

(22) Filed: Oct. 1, 2002

(51) Int. Cl.[7] ..... A47K 3/022

(52) U.S. Cl. ..... 4/622; 4/574.1; 4/594; 601/156; 607/86

(58) Field of Search ..... 4/622, 621, 619, 4/594, 574.1, 571.1; 601/156, 157, 158; 607/86, 111

(56) References Cited

U.S. PATENT DOCUMENTS 3,964,472 A * 6/1976 Nicollet ..... 601/157
4,761,838 A * 8/1988 Hargrove ..... 4/541.2
5,032,292 A * 7/1991 Conrad ..... 210/764
6,317,903 B1 * 11/2001 Brunelle et al. ..... 4/541.4

FOREIGN PATENT DOCUMENTS

CN 1297712 A * 6/2001
DE 2736183 A1 * 2/1979
KR 2002004637 A * 1/2002

* cited by examiner

*Primary Examiner*—Gregory Huson
*Assistant Examiner*—Huyen Le
(74) *Attorney, Agent, or Firm*—Ladas & Parry

(57) ABSTRACT

The present invention relates to a footcare whirlpool massage instrument equipped with an ozone generator which can massage entire feet with jets of high-pressure water and simultaneously sterilize minute germs on the feet with ozone jets. In a footcare whirlpool massage instrument having a support base and a footbath part formed on the support base and into which water is jetted, the footcare whirlpool massage instrument equipped with an ozone generator according to the present invention further comprises an ozone generator installed inside the support base and for jetting ozone into the footbath part.

3 Claims, 3 Drawing Sheets

FOOTCARE WHIRLPOOL MASSAGE INSTRUMENT EQUIPPED WITH AN OZONE GENERATOR

BACKGROUND OF THE INVENTION

1. Field of the Invention

The present invention relates to a footcare whirlpool massage instrument, and more particularly to a footcare whirlpool massage instrument equipped with an ozone generator capable of massaging entire feet with jets of high-pressure water and simultaneously killing minute germs on feet with ozone jets.

2. Description of the Prior Art

With the income level increase in recent years, the stress problem, which was put aside during the economic developments, is emerging as an issue at home, in society, and so on, and most people become seriously aware of the importance of health more than ever. Accordingly, diverse health auxiliary instruments and foods deeply penetrate into everyday life to form a large-scale market, and even the massage therapy, which has been handed down as one of folk remedies from generation to generation and used in a particular level of society such as athlete, is being brought into the public.

Such a massage therapy, by converting rotational motions into vibratory motions with a driving device such as a motor, has an effect of relieving muscular fatigue by stimulating acupuncture points of the human body to promote metabolism.

In recent years, as a massage instrument used for the massage therapy as stated above, a massage chair from which users can obtain the massage effect on their neck, back parts, and the like, while comfortably sitting thereon, has been developed and widely used, such a massage chair is provided with a vibration-generating device, and users can control its vibration strength and pattern to their desires. Further, a message chair having a footbath has been developed and widely used which can relieve back and neck fatigue together with foot fatigue at the same time Such a massage chair having a footbath takes in reservoir water of the footbath and strongly jets into the footbath to produce whirlpool which presses and massages feet.

However, the conventional massage instrument as described above which generates whirlpool which massages feet massages and washes feet in the footbath by using the whirlpool generated by water jets, but has a limit in eliminating up to minute germs on feet with only the water jets.

SUMMARY OF THE INVENTION

Accordingly, the present invention has been devised to solve the above problem, so it is an object of the present invention to provide a footcare whirlpool massage instrument equipped with an ozone generator which can form whirlpool in a footbath with high-pressure water jets in order for the whirlpool to press and massage the surfaces of feet and simultaneously kill minute germs on the feet with ozone jets into the footbath.

In order to achieve the above object of the present invention, a footcare whirlpool massage instrument equipped with an ozone generator according to the present invention, in a footcare whirlpool massage instrument having a support base and a footbath part formed on the support base and into which water is jetted, further comprises an ozone generator installed inside the support base and for jetting ozone into the footbath part.

Further, according to a preferred feature of the present invention, the ozone generator includes a case installed in the support base; a control circuit part installed in the case and for supplying electric power from external; an ozone generator installed in the case and connected to the control circuit part, and for generating ozone based on controls of the control circuit part; a discharge hose connected to an outlet side of the ozone generator and for discharging the generated ozone outside the case; and an ozone switch connected to the control circuit part and for turning on and off operations of the ozone generator.

Further, according to another feature of the present invention, the discharge side of the discharge hose is connected to a transfer path for transferring water into the footbath part in order for the ozone to be jetted into the footbath part together with water.

BRIEF DESCRIPTION OF THE DRAWINGS

The above object and other features of the present invention will become more apparent by describing in detail a preferred embodiment thereof with reference to the attached drawings, in which.

DETAILED DESCRIPTION OF THE PREFERRED EMBODIMENT

Hereinafter, the features and operations of the above structure will be more concretely described through a footcare whirlpool massage instrument equipped with an ozone generator according to a preferred embodiment of the present invention.

Figure 1:
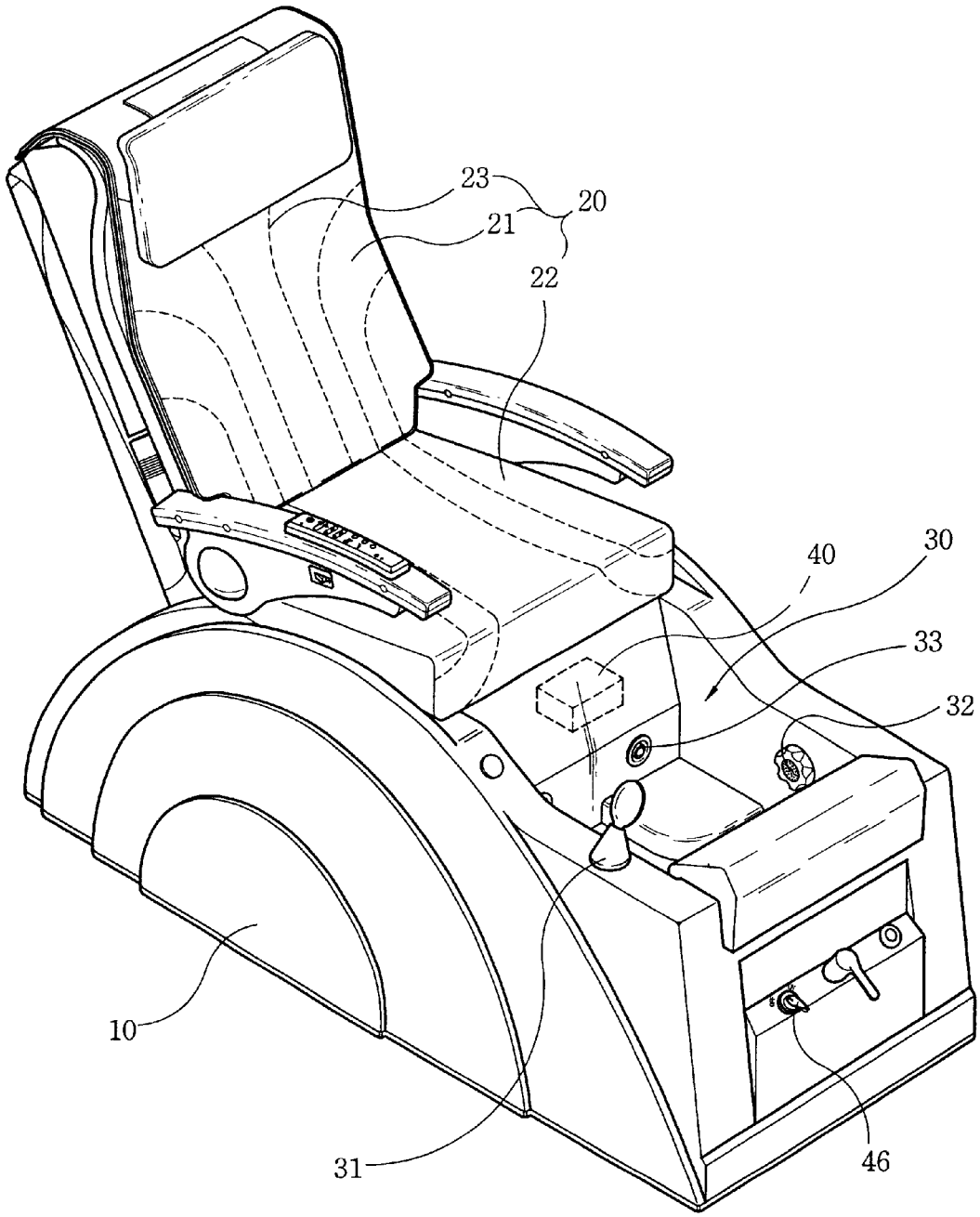
FIG. 1 is a perspective view for showing a footcare whirlpool massage instrument equipped with an ozone generator according to an embodiment of the present invention.

As shown in FIG. 1, a footcare whirlpool massage instrument equipped with an ozone generator according to a preferred embodiment of the present invention comprises a support base 10 having a predetermined height, a seat part 20 mounted on the support base 10 in order for the neck and back of a user to be comfortably massaged, a footbath part 30 formed in one body with the support base 10, and an ozone generation part 40 mounted inside the support base 10 to generate ozone.

The seat part 20 has a back support part 21 for support the back of a user and a seat part 22 for supporting the hip of the user, and inside the back support part 21 and the seat part 22 is respectively installed hot wires generating heat of 50 ~70° C. to relax muscle and double a massage effect when massaging.

In here, the seat part 20 is mounted to move back and forth on the upper part of the support base 10, the back support part 21 folds back and forth for the body shape or convenience of a user, and inside the back support part 21 is mounted a massage device(not shown) for performing the massage function. Therefore, a user can properly adjust an angle of the back support part 21, operate the massage device, and receive massages while taking rest in a comfortable posture.

The footbath part 30 is formed in the front part of the support base 10 and in a predetermined depth to hold water to a certain level, and in the upper part of the footbath part 30 is mounted a shower 31 for filling the footbath part 30 with water.

Further, in a predetermined position of the footbath part 30 is formed an intake opening 32 connected to an inlet side of a circulation pump 50 installed in the support base 10 to take in the water of the footbath part 30 based on the operations of the circulation pump 50, and in another predetermined position of the footbath part is mounted a jet nozzle 33 connected to an outlet side of the circulation pump 50 to jet water mixed with air into the footbath part 30 by way of the circulation pump 50.

Accordingly, water taken in through the intake opening 32 is jetted in a high pressure by way of the jet nozzle 33 after passing through the circulation pump 50 to generate whirlpool, and the whirlpool presses and massages the surfaces of user's feet.

Figure 2:
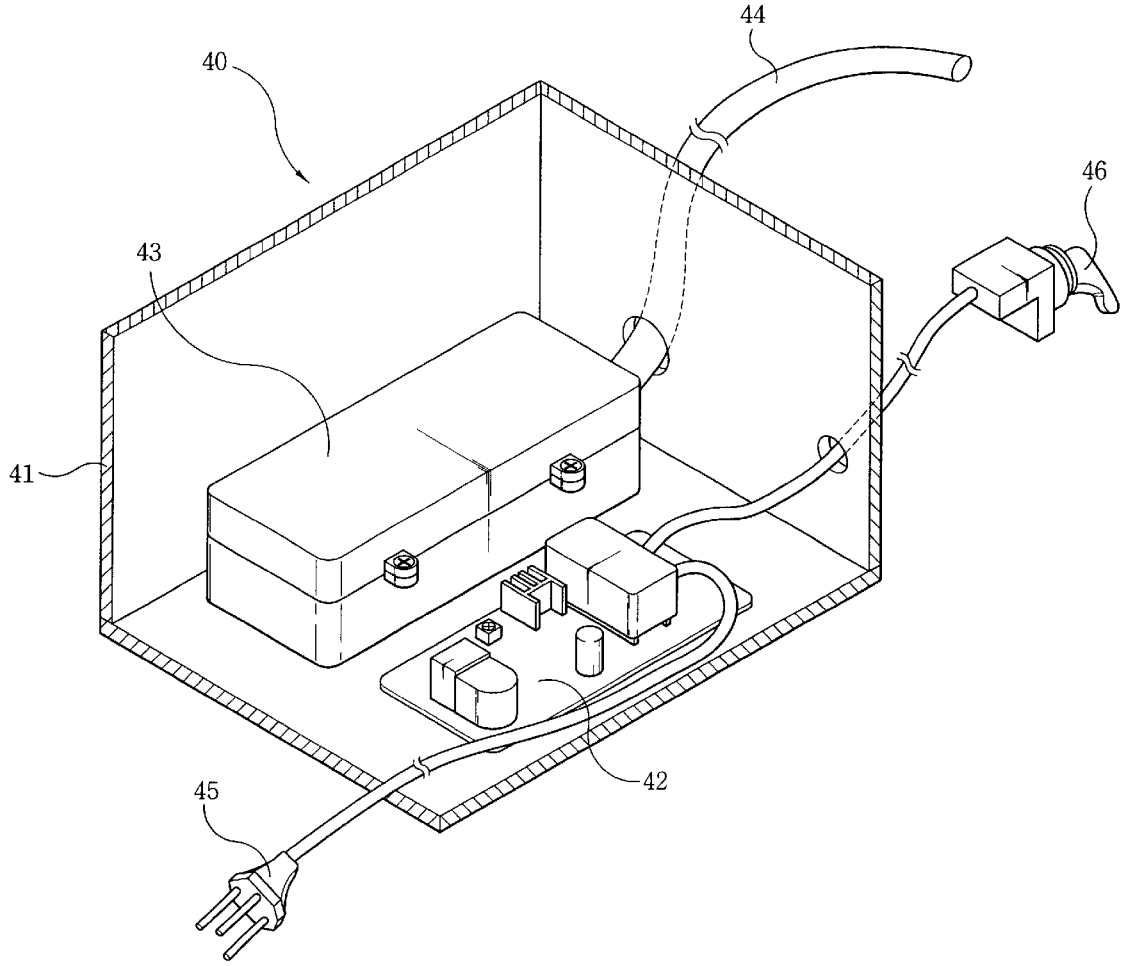
FIG. 2 is a partially cut-open perspective for showing an internal structure of the ozone generator of FIG. 1.
Figure 3:
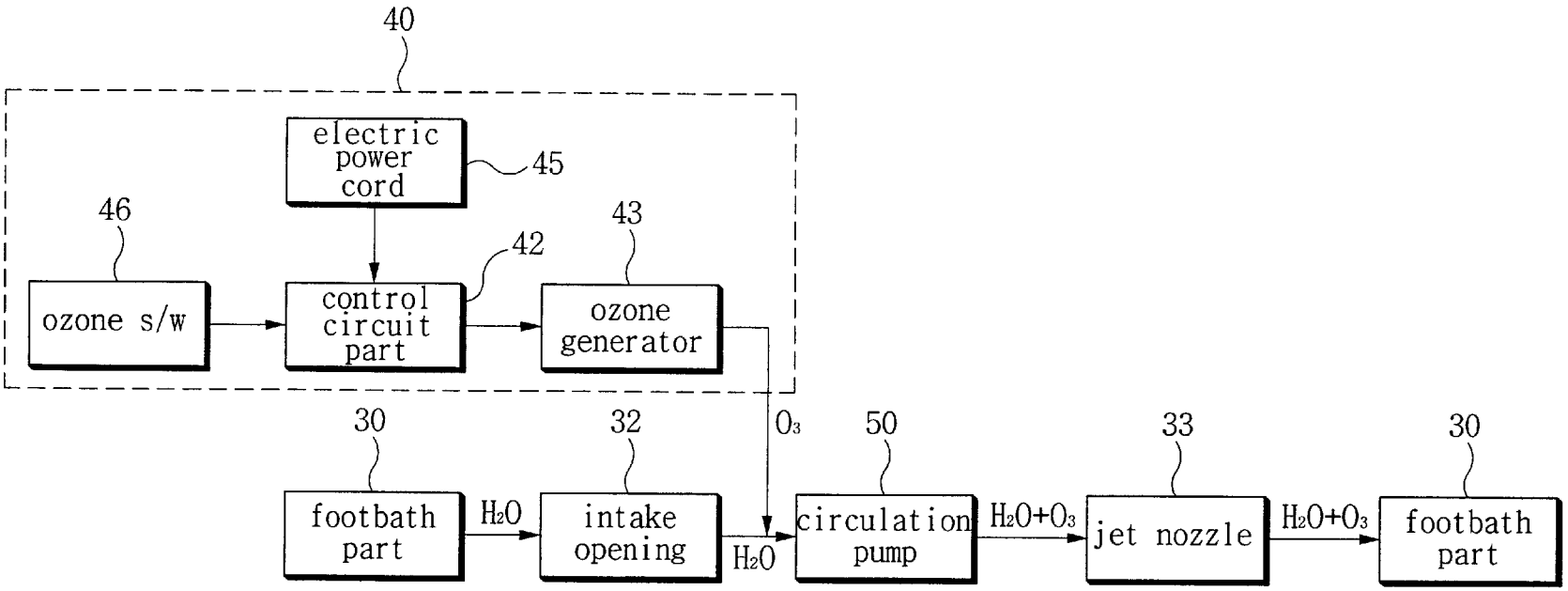
FIG. 3 is a view for schematically showing a ozone-generating and jetting process.

As shown in FIG. 2, the ozone generator 40 supplies ozone($O_3$) into the footbath part 30 to kill even minute germs on feet, which has a case 41 mounted inside the support base 10, a control circuit part 42 installed in the case 41, an ozone generator 43 installed in the case 41 and for generating ozone based on the control of the control circuit part 42, a discharge hose 44 one end of which is connected to the discharge side of the ozone generator 43 and the other end of which passes through the case and is connected to a water hose(not shown) connecting the intake opening 32 of the footbath part 30 and the circulation pump 50, an electric power cord 45 connected to the control circuit part 42 and for supplying electric power to the control circuit part 42 from external, and an ozone switch 46 connected to the control circuit part 42 and for turning on and off the operation of the ozone generator and simultaneously controlling an ozone generation amount.

The ozone generated from the ozone generator 43 is supplied to the water hose through the discharge hose 44 and is mixed with water in the circulation pump 50, and the ozone mixed with water is jetted into the footbath part 30 through the jet nozzle 33 to sterilize feet.

The operations of the footcare whirlpool massage instrument equipped with an ozone generator structured as above according to an embodiment of the present invention are described as follows.

First, a user takes a seat in the seat part 20 and adjusts the seat part 20 to have a comfortable posture.

After the user adjusts the seat part 20 and takes a seat in a comfortable posture, as the user uses the shower 31 to fill the footbath part 30 with water and then activates the circulation pump 50, the water of the footbath part 30 is absorbed into the circulation pump 50 through the intake opening 32, mixed with air while passing the circulation pump 50, and jetted into the footbath part 30 through the jet nozzle 31. At this time, the water and air jetted in a high pressure through the jet nozzle 31 forms whirlpool naturally, and the whirlpool presses and massages the surfaces of the feet.

In the meantime, if the ozone switch 46 of the ozone generator 40 is turned on, ozone is generated from the ozone generator 43, the generated ozone is supplied to the water hose connecting the intake opening 32 of the footbath part 30 and the circulation pump 50 through the discharge hose 44 and mixed with water in the circulation pump 50, and jetted together with water into the footbath part 30 from the jet nozzle 31, to thereby sterilize feet. At this time, the ozone sterilizes minute germs on the feet to maintain the feet clean, prevent the skin from aging, and to keep skin elastic.

As stated above, although a footcare whirlpool massage instrument equipped with an ozone generator according to a preferred embodiment of the present invention is described with reference to the attached drawings, the present invention is not limited to the embodiment and drawings described in detail in the specification, and various changes and modifications can be made within the technical spirit and scope of the present invention. For example, the same sterilization effect can be obtained with direct jets of ozone into the footbath art through the discharge hose by directly connecting the discharge hose of the ozone generator to the footbath part, the structure of which should be deemed to belong to the scope of the right to the present invention.

As described in detail as above, the footcare whirlpool massage instrument equipped with an ozone generator according to the present invention can conveniently massage feet with whirlpool formed by jets of high-pressure water through the jet nozzle of the footbath part, as well as sterilize even minute germs on the feet with ozone generated from the ozone generator and jetted into the footbath part together with water.

What is claimed is:

1. A footcare whirlpool massage instrument, comprising:

a support base;

a footbath part on the support base for receiving jetted-in water;

an ozone generator inside the support base for jetting ozone into the footbath part, wherein the ozone generator includes:

a case;

a control circuit part in the case, the ozone generator also being in the case and connected to the control circuit part for receiving electric power from external and generating ozone based on controls of the control circuit part;

a discharge hose connected to an outlet side of the ozone generator for discharging the generated ozone outside the case; and an ozone switch connected to the control circuit part and for turning the ozone generator on and off.

2. The footcare whirlpool massage instrument as claimed in claim 1, wherein the discharge side of the discharge hose is connected to a transfer path of water jetted into the footbath part in order for the ozone to be jetted into the footbath part together with water.

3. The footcare whirlpool massage instrument as claimed in claim 1, wherein the discharge side of the discharge hose is connected to the footbath part in order for the ozone to be directly jetted into the footbath part.

* * * * *